US010343804B2

(12) United States Patent
Schlumberger

(10) Patent No.: US 10,343,804 B2
(45) Date of Patent: Jul. 9, 2019

(54) METHOD FOR FILLING PACKAGING HOLDERS

(71) Applicant: Uhlmann Pac-Systeme GmbH & Co. KG, Laupheim (DE)

(72) Inventor: Albert Schlumberger, Achstetten-Bronnen (DE)

(73) Assignee: UHLMANN PAC-SYSTEME GMBH & CO. KG, Laupheim (DE)

( * ) Notice: Subject to any disclaimer, the term of this patent is extended or adjusted under 35 U.S.C. 154(b) by 412 days.

(21) Appl. No.: 15/177,063

(22) Filed: Jun. 8, 2016

(65) Prior Publication Data

US 2016/0362213 A1 Dec. 15, 2016

(30) Foreign Application Priority Data

Jun. 9, 2015 (EP) ..... 15171253

(51) Int. Cl.

| | |
|---|---|
| ***B65B 35/00*** | (2006.01) |
| ***B65B 57/14*** | (2006.01) |
| ***B65B 23/22*** | (2006.01) |
| ***B65B 57/16*** | (2006.01) |

(52) U.S. Cl.

CPC ..... *B65B 57/14* (2013.01); *B65B 23/22* (2013.01); *B65B 35/00* (2013.01); *B65B 57/16* (2013.01)

(58) Field of Classification Search

CPC ..... B65B 57/14; B65B 23/22; B65B 57/16; B65B 35/00; B65B 5/08; B81C 99/004

USPC ... 53/473, 52, 235, 246–248, 501, 537, 539, 53/544, 493–495, 497–499, 443, 448, 53/476, 54; 100/99

See application file for complete search history.

(56) References Cited

U.S. PATENT DOCUMENTS 3,431,702 A * 3/1969 Spaulding ..... B65B 21/16 414/627
3,762,251 A * 10/1973 Madsen ..... B65B 11/52 83/39
3,979,878 A * 9/1976 Berney ..... B65B 35/30 53/495

(Continued)

FOREIGN PATENT DOCUMENTS

JP H0811827 A 1/1996
WO WO 2012/004814 A2 1/2012

OTHER PUBLICATIONS

European Search Report for EP 15171253 dated Nov. 19, 2015.

*Primary Examiner* — Stephen F. Gerrity
*Assistant Examiner* — Katie L Gerth
(74) *Attorney, Agent, or Firm* — Brinks Gilson & Lione

(57) ABSTRACT

One method for filling packaging holders with products comprises the steps of providing a pushing-in unit, which comprises a pushing-in device for pushing products into the packaging holders and a mechanical testing system for testing an arrangement and orientation of the products, prepositioning the products in openings of the packaging holders, actuating the mechanical testing system for testing an arrangement and orientation of the products in the openings of the packaging holders, actuating the pushing-in device and pushing the products into the packaging holders if it has been determined during the testing step that the products are correctly arranged and oriented, and interrupting the filling operation if it has been determined during the testing step that at least one of the products is incorrectly arranged or oriented.

14 Claims, 6 Drawing Sheets

(56) References Cited

U.S. PATENT DOCUMENTS

| | | | | | |
|---|---|---|---|---|---|
| 4,435,941 | A * | 3/1984 | Booth | B65B 25/046 | 53/247 |
| 4,514,956 | A * | 5/1985 | Varallo | B65B 5/105 | 53/148 |
| 4,525,985 | A * | 7/1985 | Sammens | B65B 5/08 | 198/434 |
| 4,648,232 | A * | 3/1987 | Brinker | B65B 19/28 | 209/535 |
| 4,693,057 | A | 9/1987 | Rittinger et al. | | |
| 4,709,535 | A * | 12/1987 | Mahaffy | B65B 31/021 | 53/247 |
| 5,097,653 | A * | 3/1992 | Soloman | B65B 57/10 | 493/9 |
| 5,524,414 | A * | 6/1996 | Spada | B65B 19/32 | 209/535 |
| 5,675,957 | A * | 10/1997 | Kim | G01R 31/2851 | 414/225.01 |
| 7,921,622 | B2 * | 4/2011 | Bertuzzi | B65B 63/005 | 131/283 |
| 8,406,916 | B2 * | 3/2013 | Bentele | B65B 5/103 | 104/28 |
| 8,407,973 | B2 * | 4/2013 | Finkowski | A21C 9/086 | 53/247 |
| 8,973,341 | B2 * | 3/2015 | Bartoli | B26D 1/205 | 53/477 |
| 2003/0213215 | A1 * | 11/2003 | Cho | B29C 45/768 | 53/499 |
| 2004/0148908 | A1 * | 8/2004 | Focke | A24C 5/343 | 53/54 |
| 2007/0130890 | A1 * | 6/2007 | Barrett | A61J 3/075 | 53/468 |

* cited by examiner

METHOD FOR FILLING PACKAGING HOLDERS

RELATED APPLICATIONS

The present patent document claims the benefit of and priority to European Patent Application No. EP 15171253.6 filed Jun. 9, 2015, the entire contents of which are incorporated herein by reference.

FIELD AND BACKGROUND

The present disclosure relates to a method for filling packaging holders, which are formed in a base packaging body, with products.

In the packaging of medical products such as ampoules, syringes, inhalers, etc., so-called "clamping packs" are used, among other types. These clamping packs usually consist of a package base body, in which a plurality of pocket-like packaging holders are formed. The openings of the packaging holders are dimensioned so that, before the products are pushed in, they first rest on the edges of the opening and arrive in their final position in the packaging holders only after a mechanical force has pushed them in. After the mechanical pushing-in step, the products are clamped in position in the clamping pack.

During packaging, the products are usually first prepositioned in the openings of the packaging holders. Then a pushing-in device is actuated to push the products into the packaging holders. Any product can be reliably pushed into a packaging holder as long as it is possible for the product to be positioned correctly in the assigned opening and/or oriented properly with respect to the geometry of the packaging holders. If, when a product is placed on the base packaging body, it does not end up in the assigned opening but rather, for example, in the area between the openings of two packaging holders, one of the packaging holders will not be filled, and the product and/or the base packaging body will be damaged by the attempted pushing-in operation. The product and/or the packaging can also be damaged during the pushing-in operation if a product has been prepositioned with the wrong orientation. In both cases, the package in question must be ejected, and the entire machine must be stopped.

SUMMARY

It is therefore an object of the present disclosure to provide a method for filling packaging holders with products which increases the reliability of the process and minimizes the down times of the machine.

According to an aspect of the present disclosure, a method for filling packaging holders with products comprises the following steps:

- providing a pushing-in unit, which comprises a pushing-in device for pushing products into packaging holders and a mechanical control system for controlling the arrangement and orientation of the products;
- prepositioning the products in openings of the packaging holders;
- actuating the mechanical testing system for testing the arrangement and orientation of the products in the openings of the packaging holders;
- actuating the pushing-in device and pushing the products into the packaging holders if it has been determined during the testing step that the products are correctly arranged and oriented; and
- interrupting the filling operation if it has been determined during the testing step that at least one of the products is incorrectly arranged or oriented.

The advantage of this method is that the products are pushed into the packaging holders only if it has been ruled out that any of the products are arranged or oriented incorrectly in the openings of the packaging holders. Even before a product and/or a base packaging body can be damaged as a result of an incorrect arrangement or orientation of a product, the filling operation can be interrupted and the problem corrected immediately. Accordingly, the reliability of the process is increased and down times are minimized.

The pushing-in device, furthermore, in one form comprises at least one pushing-in element for pushing the products into the packaging holders, wherein the at least one pushing-in element is moved toward the base packaging body to push the prepositioned product into its final position in the packaging holder. The pushing-in operation therefore represents a movement which is independent of the movement of the base packaging body. Accordingly, the pushing-in process can be controlled separately, which is important in particular so that the process can be interrupted rapidly.

In a preferred embodiment, the mechanical testing system comprises a testing element, which is moved down from above, toward the base packaging body to test the arrangement and orientation of the products. Thus the testing element and the pushing-in device can be guided jointly at least over part of the distance, which simplifies the course of the process. Another advantage is to be found in the possibility of providing only a single drive and guide device for the testing element and the pushing-in element. Complexity and costs can thus both be reduced.

The testing element is preferably moved perpendicularly down toward the usually horizontal conveying device of the base packaging body. This offers the advantage that any products set down by mistake in the areas between the openings are detected by the testing element at the earliest possible moment. The faster an error is detected, the faster a correction can be made and the less the overall throughput of the packaging process is affected.

The testing system generates an error signal when the testing element contacts one of the products as it moves toward the base packaging body. It is especially advantageous that, as a result of this, it is possible to transmit the error state in the shortest possible time directly to a control unit, which immediately interrupts the process. Damage to the products or to the base packaging body can thus be effectively prevented.

In a preferred embodiment, the testing element is provided in the form of a testing plate, in which through-openings are formed, wherein the testing plate and a section of the base packaging body are arranged relative to each other in such a way that the openings of the packaging holders and the through-openings lie on top of each other. As a result, the areas which are defined are precisely those in which a product is allowed and those in which no product may be present, such as the area between two adjacent openings. Another advantage consists in that, with the use of a testing plate, a large number of products can be checked simultaneously, so that the testing process can proceed very quickly.

If the openings and the through-openings have the same shape and are of the same size, it is also possible to check the orientation of the products in the openings. For example, an oval product incorrectly positioned crosswise in an oval opening can be reliably detected by a testing plate with oval through-openings.

The testing plate is preferably arranged parallel to the base packaging body. As a result, the prepositioned products can be tested simultaneously for correctness, because the through-openings reach their assigned products simultaneously as the testing plate moves downward. The testing process thus takes very little time, and the error-correction process can be initiated quickly.

The testing plate and the at least one pushing-in element, furthermore, are preferably moved jointly toward the base packaging body, wherein the testing plate is arranged closer to the base packaging body than the at least one pushing-in element. This movement can be accomplished in a single step of the method, and only a single drive is required to move the pushing-in element and the testing plate. Manufacturing costs are thus reduced. Because the testing plate is closer to the base packaging body, testing takes place before the pushing-in process. The pushing-in process can be interrupted promptly if an error is detected.

As soon as an error is detected by the testing system, both the testing plate and the at least one pushing-in element are stopped and then moved back. Thus the tested base packaging body can be moved as quickly as possible back out of the test area, and the next base packaging body can be moved in to replace it.

If the testing system does not detect any errors, the at least one pushing-in element moves further down and thus passes through the through-openings in the testing plate. The pushing-in process therefore occurs only at tested positions and only after it has been ensured that the orientation is correct. Especially reliable control is thus possible.

After the products have been pushed into place, the pushing-in element and the testing plate are moved back jointly. Thus the testing plate and the pushing-in device can be guided together over part of the distance, which simplifies the course of the movement. An advantage is derived from the possibility that only one drive and one guide device need to be provided for the testing plate and the pushing-in device.

It is especially advantageous for the base packaging body to be moved in a timed, stepwise manner in the conveying direction. The pushing-in unit can therefore be stationary, and the base packaging body with the packaging holders can be standing still in the testing and pushing-in area. The time window between two of these timed steps is utilized to test the prepositioning and to push in the products.

DETAILED DESCRIPTION OF SPECIFIC EMBODIMENTS

Figure 1:
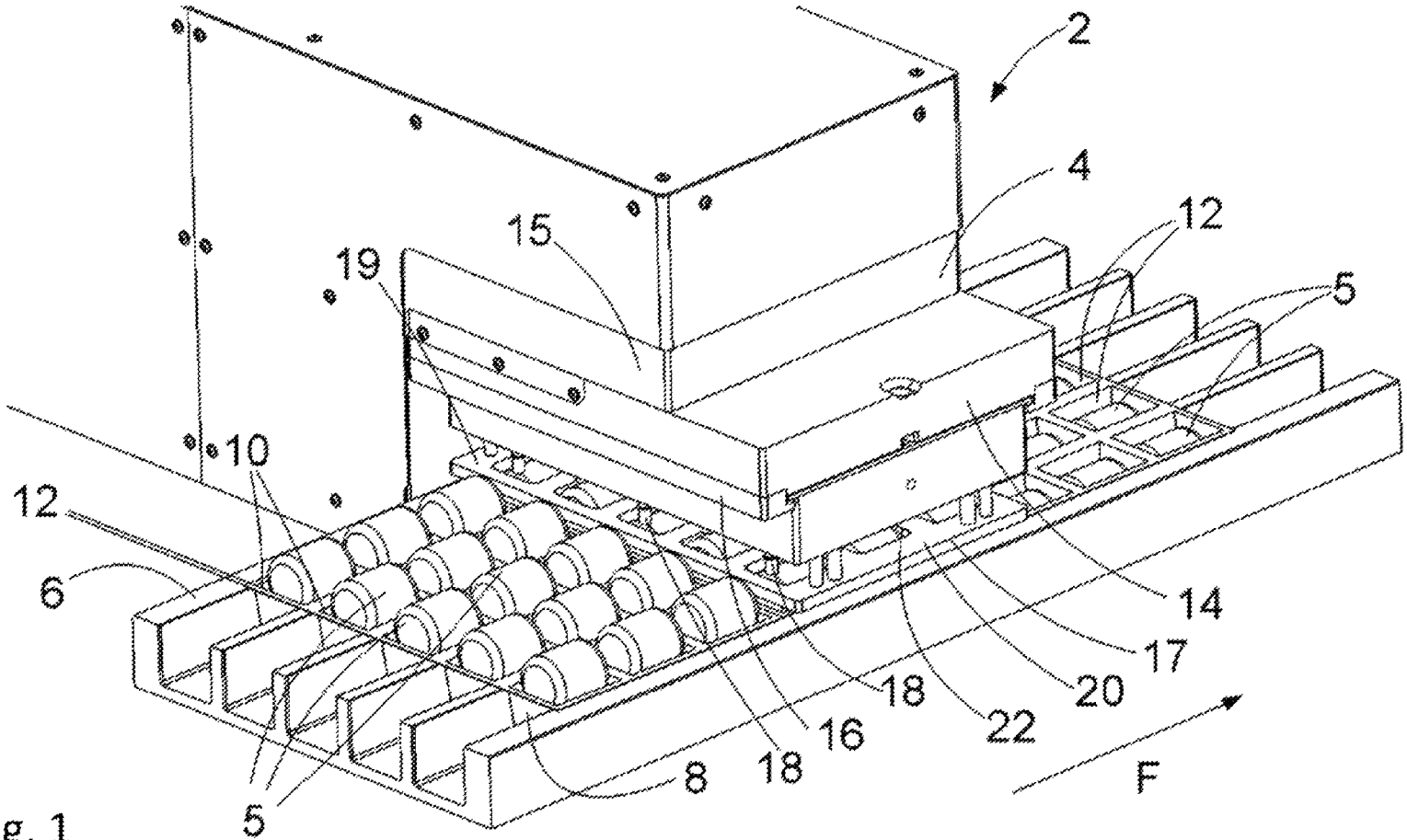
FIG. 1 is a perspective view of a pushing-in unit, which can be used in a method according to the present disclosure.

FIG. 1 is a perspective view of a conveying device 6 for conveying packaging base bodies 8, which are to be filled with products 5 (e.g., ampoules, bottles, vials, syringes, inhalers, etc.), in a conveying direction F, and a pushing-in station 2 with a pushing-in unit 4 for pushing the products 5 into the packaging holders 10 of the base packaging body 8.

Many different embodiments of these types of conveying devices 6 are known from the prior art. To this extent no further description is necessary. The conveying device 6 preferably moves the packaging base bodies 8 in a timed, stepwise manner. The packaging base bodies 8 can be elements which are separated from each other, or they can be sections of a continuous web, such as a web of film material.

The substantially L-shaped pushing-in station 2 comprises an open section in the lower area, through which the path traveled by the packaging base bodies 8 in the conveying direction F extends. The pushing-in unit 4 in the pushing-in station 2 is provided in such a way that the path of the packaging base bodies 8 passes directly under the pushing-in unit 4.

In the packaging base bodies 8, there is a plurality of pocket-like packaging holders 10, each with an opening 12. The packaging holders 10 in each base packaging body 8 are arranged in rows and columns, which are perpendicular to each other. Any other suitable arrangement could also be used.

FIG. 1 shows a base packaging body 8 in a leading position with respect to the conveying direction F. A product 5 has already been pushed into each of the packaging holders 10 of this base packaging body 8. FIG. 1 also shows a base packaging body 8 which is in a middle position relative to the conveying direction F. In this case, the prepositioned products 5 are just being tested for correct orientation. Finally, FIG. 1 shows a base packaging body 8 in a trailing position relative to the conveying direction F. Here the products 5 are prepositioned in the openings 12 of the packaging holders 10.

As can be seen on the basis of the base packaging body 8 in the trailing position relative to the conveying direction F, the products 5 are more-or-less cylindrical in shape, and the openings 12 of the packaging holders 10 are rectangular, wherein the longitudinal direction of the openings 12 points in the conveying direction F. All of the products 5 located on the trailing base packaging body 8 are prepositioned with the correct orientation in the openings 12. That is, all of the cylindrical products 5 are arranged in the openings 12 in such a way that the longitudinal direction of the cylindrical products 5 also points in the conveying direction F. As can also be seen in FIG. 1, the products 5 lie in the openings 12 of the packaging holders 10 in such a way that less than half of the product 5 extends into the packaging holder 10. The section of the product 5 with the widest cross section is located outside the packaging holder 10.

The pushing-in unit 4 comprises a pushing-in device 14 for pushing the products 5 into the packaging holders 10. The pushing-in device 14 comprises a pushing plate 16 and a plurality of pushing-in elements 18, which are mounted on the bottom surface of the pushing plate 16. The pushing-in device 14 also comprises a mechanical testing system 19 with a testing element 17, which is described in greater detail below on the basis of FIG. 2. Finally, the pushing-in device 14 comprises a motion unit 15 for moving the pushing plate 16 and the testing element 17, especially also for moving them independently of each other, back and forth in the pushing direction, which is perpendicular to the conveying direction F.

Figure 2:
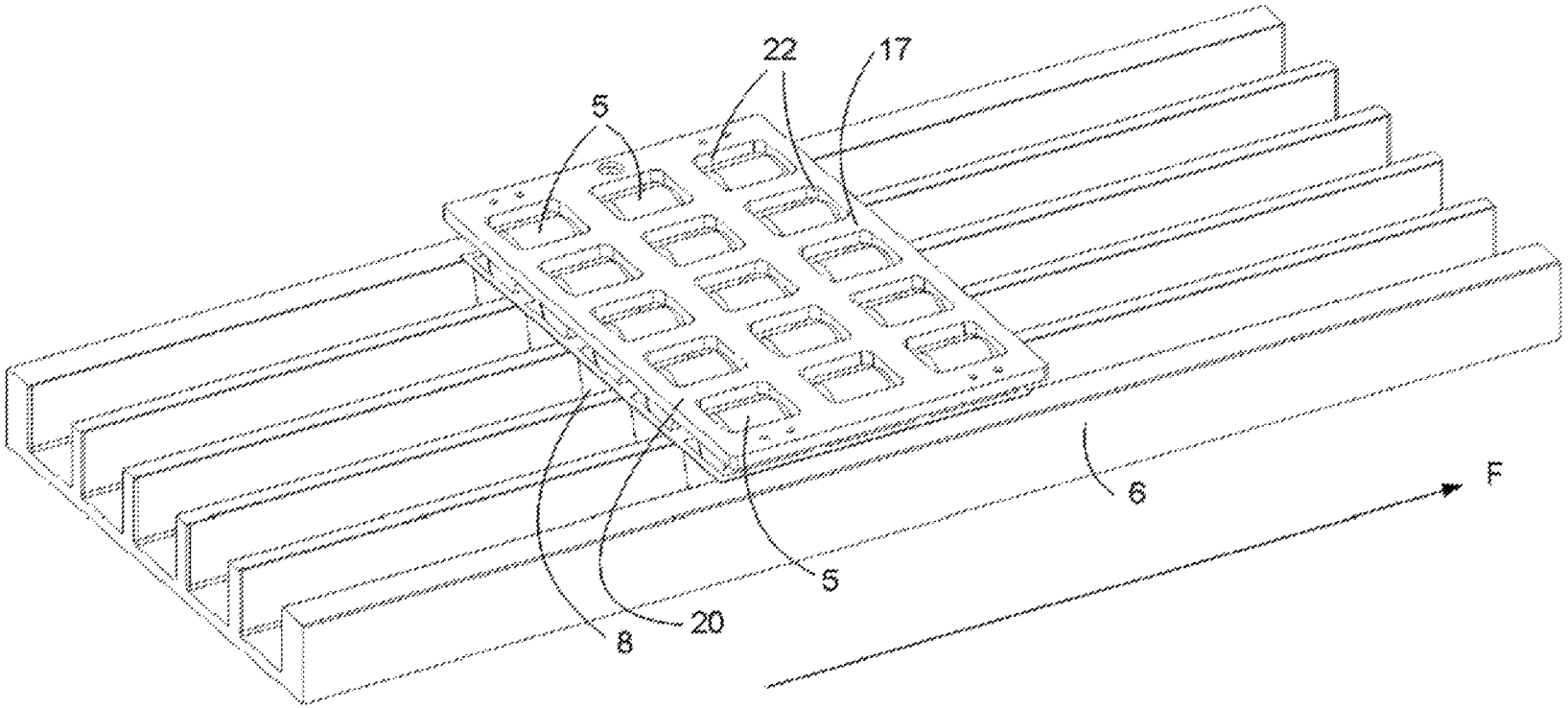
FIG. 2 is a perspective view of a testing plate of the pushing-in unit of FIG. 1.

FIG. 2 shows the testing element 17 of the pushing-in device 14. In the example shown here, the testing element 17 is configured as a testing plate 20. Other mechanically moved parts, however, could also be used as testing elements 17. The testing element 17 does not have to have the shape of a plate. The testing element 17 can also comprise several parts which do not even have to be connected to each other.

A plurality of through-openings 22 is formed in the testing plate 20. A base packaging body 8 is located in the pushing-in area. One product 5 is positioned in the opening 12 of each packaging holder 10 and rests on the edge of the opening 12 (FIG. 1). The testing plate 20 for testing the products 5 for correct orientation is arranged above the base packaging body 8. The through-openings 22 are located directly above the openings 12 of the packaging holders 10. In the case shown here, all of the products 5 are correctly aligned in the openings 12, so that the products 5 extend through the through-openings 22, and the testing plate 20 passes by the products 5 without touching them.

In the following, the individual phases of a possible embodiment of the method according to the invention is explained in greater detail on the basis of FIGS. 3A-3C.

Figure 3A:
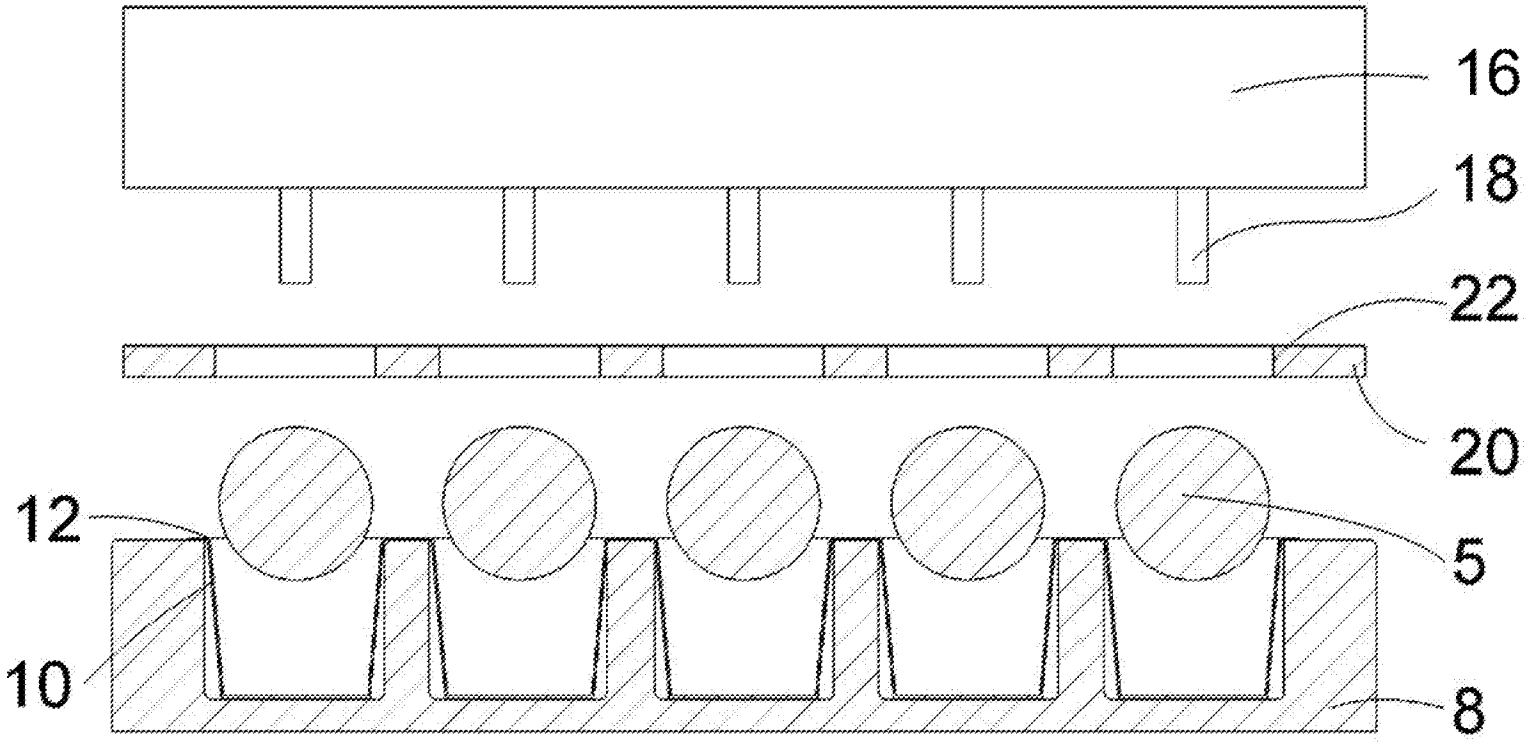
FIGS. 3A-C are schematic cross sections of a pushing-in unit, in which three phases of a preferred embodiment of the method according to the invention are illustrated.
Figure 3B:
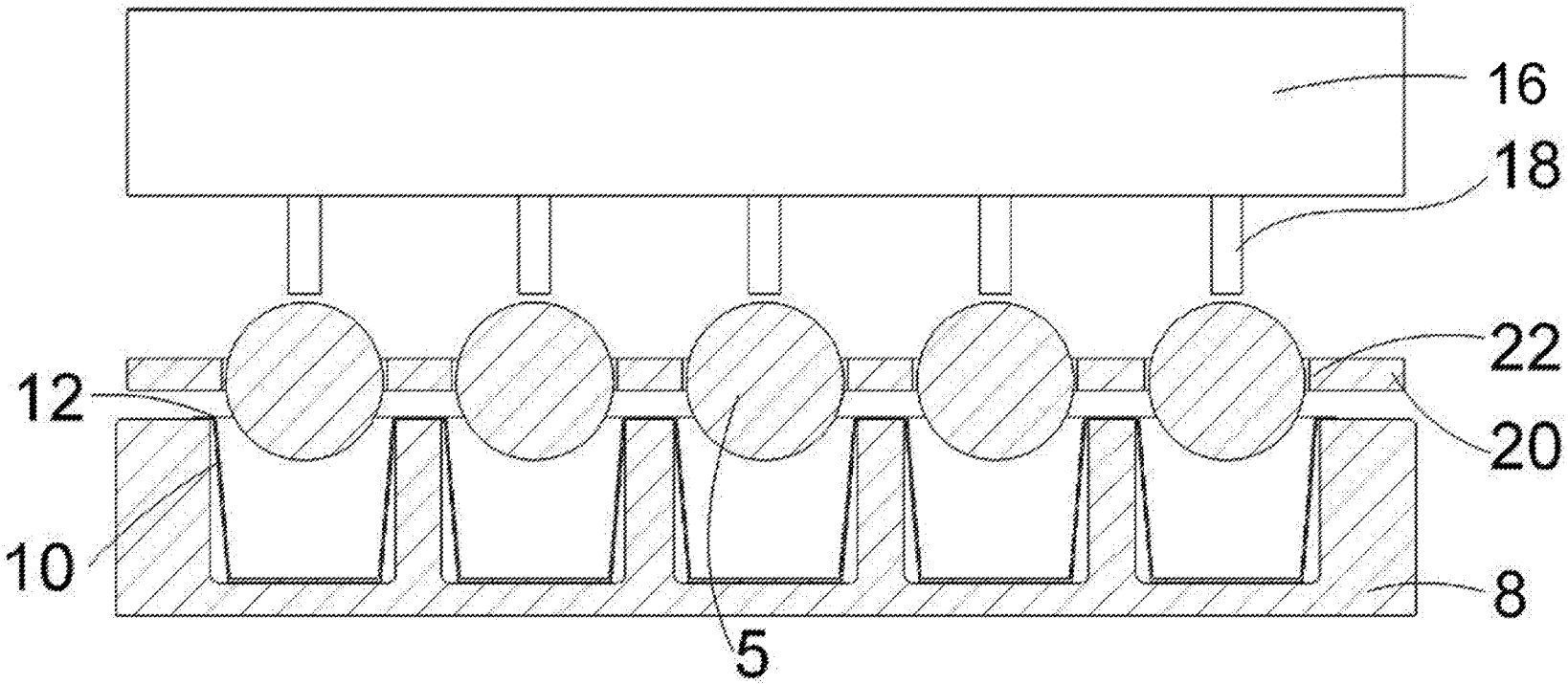
Figure 3C:
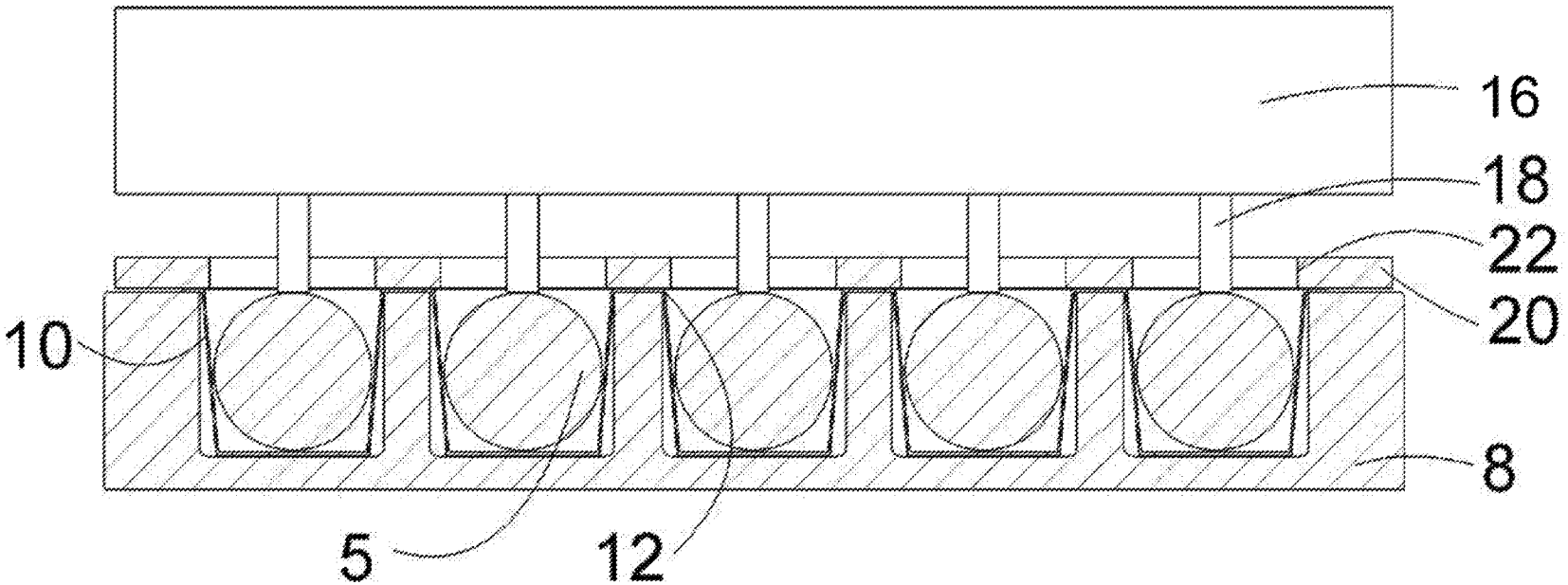

FIGS. 3A-3C are schematic cross-sectional views of a pushing-in device 14 with pushing plate 16 and testing plate 20 and of a base packaging body 8. Three phases of an exemplary embodiment of the method according to the invention are represented. For the sake of clarity, the other elements of the pushing-in device 14 have been omitted.

In the first phase, shown in FIG. 3A, products 5 have already been prepositioned in the openings 12 of the packaging holders 10 and are resting on the edges of the openings 12 of the packaging holders 10. The testing plate 20 with the through-openings 22 formed in it is located above and a certain distance away from the base packaging body 8. Above and a certain distance away from the testing plate 20, furthermore, there is a pushing plate 16 with the pushing-in elements 18, which project from the bottom surface of the pushing plate 16. As can also be seen in FIG. 3A, the through-openings 22 are aligned with the openings 12 of the packaging holders 10, and the pushing-in elements 18 are in turn aligned with the through-openings 22.

In the second phase, shown in FIG. 3B, the testing plate 20, proceeding from the diagram of FIG. 3A, has been moved downward from above toward the base packaging body 8. The correctly oriented products 5 in FIG. 3B are now in the through-openings 22. As the testing plate 20 was moved downward, it experienced no resistance from any incorrectly arranged or oriented products 5, so that the testing system 19 did not generate an error signal. In addition, the pushing plate 16, proceeding from the diagram of FIG. 3A, has been moved downward toward the base packaging body 8 together with the testing plate 20.

In the third phase, shown in FIG. 3C, proceeding from FIG. 3B, the pushing plate 16, with the pushing-in elements 18 mounted on it, has been moved even farther down toward the base packaging body 8 and the prepositioned products 5. The testing plate 20 is now resting on the base packaging body 8 and has come to a halt there, so that the distance between the pushing plate 16 and the testing plate 20 has been significantly reduced. As can be seen in FIG. 3C, the products 5 have been pushed into their assigned packaging holders 10 by the pushing-in elements 18. The pushing-in elements 18 thus pass through the through-openings 22 in the testing plate 20

Proceeding from the diagram of FIG. 3C, the pushing plate 16 and the testing plate 20 can now be moved upward again. Then the base packaging body 8 with the pushed-in products 5 is sent to a sealing station (not shown), while the next base packaging body 8 with prepositioned products 5 is moved up from behind into the pushing-in area, so that the state shown in FIG. 3A is reached again.

Figure 4:
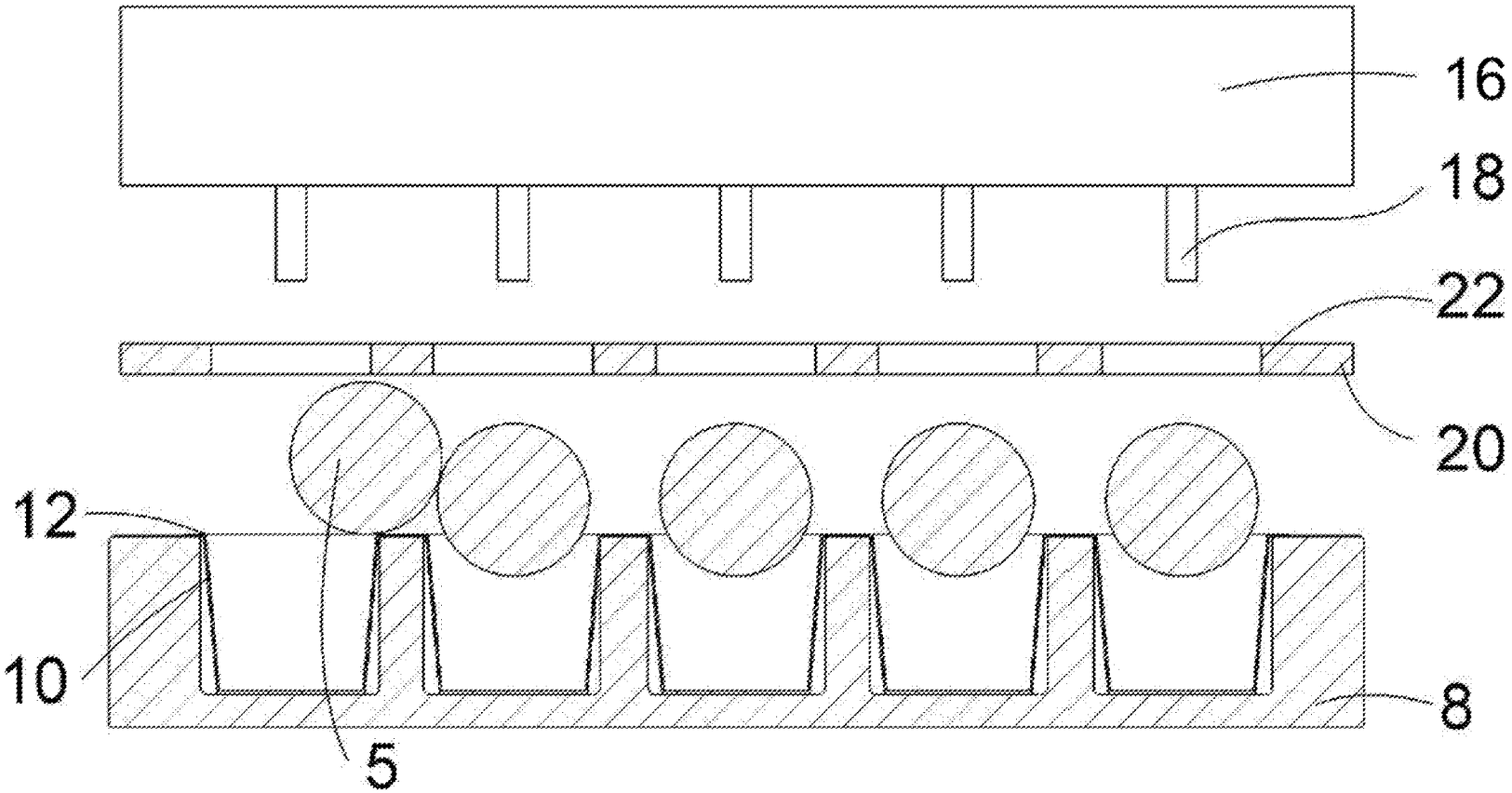
FIG. 4 is a schematic cross section of the pushing-in unit of FIGS. 3A-C, in which a fourth phase of the preferred embodiment of the method according to the present disclosure is illustrated.

FIG. 4 shows a schematic diagram of a situation in which a product 5 has not been arranged correctly. As can be seen, the product 5 on the left in FIG. 4 is not in its assigned opening 12 on the left but rather in the area on the base packaging body 8 between the openings 12 of two packaging holders 10. In contrast to the phase shown in FIG. 3B, the testing plate 20 now experiences resistance from the incorrectly positioned product 5, which is detected by a sensor (not shown; e.g., a force transducer, a location sensor, a camera, etc.). Then, in fractions of a second, an error signal is triggered. As a result, the filling process is interrupted, and both the pushing plate 16 and the testing plate 20 are moved back upward, away from the base packaging body 8. Then the base packaging body 8 with the products 5 which have not yet been pushed in is sent to an error-correction or sorting-out step, while the next base packaging body 8 with prepositioned products is conveyed up into the pushing-in area, so that the state shown in FIG. 3A is reached again.

To test the arrangement and orientation of the products, the testing plate 20 is moved toward the base packaging body 8. The testing plate 20 can be moved so that it contacts the top surface of the packaging base body 8, or it can be moved only until a certain minimum distance is present between the testing plate 20 and the base packaging body 8.

If only one drive for the pushing plate 16 and the testing plate 20 is present, the testing plate 20 is supported movably on the pushing plate 16 and hangs downward by its own weight a certain distance below the pushing plate 16. In the error-free, normal operating state, the testing plate 20 is then guided downward until it is supported on the packaging base body 8 (usually resting on a pad), and then the pushing plate 16 is lowered further. For this purpose, the control unit must know that, in this state, i.e., the state in which the testing plate 20 has become stationary, there is no longer any chance of an error being detected. If, however, in the case of an incorrectly placed product 5, the testing plate 20 is resting on a product 5, first only the weight of the testing plate 20 is acting on this product. The force thus exerted is much weaker than the pressing force of the pushing plate 16. The testing plate 20 is so light in weight, that the product 5 is not damaged. The process is interrupted even before the pushing-in elements 18 contact the products 5.

The pushing plate 16 and the testing plate 20 can also be connected to each other by springs.

The expression "mechanical testing system" within the scope of this description is to be understood as a system in which the testing for the presence of a product 5 is carried out by contact of the product 5 by another object, namely, by at least one testing element. When the product is contacted, the movement of the testing element meets resistance, as a result of which the incorrect arrangement or orientation of at least one product 5 is signaled. A sensor may be used to detect the resistance and initiate the signal, e.g. to a control system of the motion unit 15.

The invention claimed is:

1. A method for filling pocket-shaped holders of a packaging, which are formed in a base body of the packaging conveyed in a conveying direction, with products comprises the steps of:

providing a pushing-in unit, which comprises a pushing-in device for pushing products into the pocket-shaped holders of the packaging and a mechanical testing system for testing an arrangement and orientation of the products;

prepositioning the products in openings of the pocket-shaped holders of the packaging;

actuating the mechanical testing system for testing the arrangement and orientation of the products in the openings of the pocket-shaped holders of the packaging;

actuating the pushing-in device and pushing the products into the pocket-shaped holders of the packaging if it has been determined during the testing step that the products are correctly arranged and oriented in the openings of the pocket-shaped holders of the packaging; and interrupting the method of filling the pocket shaped-holders of a packaging if it has been determined during the testing step that at least one of the products is incorrectly arranged or oriented in the opening of at least one of the pocket-shaped holders of the packaging.

2. The method of claim 1, wherein the prepositioning of the products in the openings of the pocket-shaped holders of the packaging is carried out in such a way that part of each product projects above the opening of the associated pocket-shaped holder of the packaging.

3. The method of claim 1, wherein the pushing-in device comprises at least one pushing-in element for pushing the products into the pocket-shaped holders of the packaging, wherein the at least one pushing-in element is moved toward the base body of the packaging to push the prepositioned products into their final position in the pocket-shaped holders of the packaging.

4. The method of claim 1, wherein the testing system comprises a testing element, which is moved downward from above the products towards the base body of the packaging to test the arrangement and orientation of the products.

5. The method of claim 4, wherein the testing element is moved in a direction perpendicular to the conveying direction.

6. The method of claim 5, wherein the testing system generates an error signal if, as the testing element moves downward toward the base body of the packaging, the testing element contacts one of the products.

7. The method of claim 6, wherein the testing element is a testing plate with through-openings formed in the testing plate, wherein the testing plate and a section of the base body of the packaging are arranged relative to each other in such a way that the openings of the pocket-shaped holders of the packaging and the through-openings align with one another.

8. The method of claim 7, wherein the openings and the through-openings have the same shape and are of the same size.

9. The method of claim 7, wherein the testing plate is arranged parallel to the base body of the packaging.

10. The method of claim 7, wherein the pushing-in device comprises at least one pushing-in element for pushing the products into the pocket-shaped holders of the packaging, and wherein the testing plate and the at least one pushing-in element are moved jointly toward the base body of the packaging, wherein the testing plate is closer to the base body of the packaging than the at least one pushing-in element.

11. The method of claim 10, wherein, if an error is detected by the testing system, the testing plate and the at least one pushing-in element are stopped and then moved back.

12. The method of claim 10, wherein, if no error is detected by the testing system, the at least one pushing-in element is moved farther down and thus passes through the through-openings of the testing plate.

13. The method of claim 12, wherein, after the products have been pushed in the pocket-shaped holders in the packaging, the at least one pushing-in element and the testing plate are moved back jointly.

14. The method of claim 1, wherein the base body of the packaging is moved in the conveying direction in a timed, stepwise manner.

* * * * *